US005333468A

United States Patent [19]

Rice

[11] Patent Number: 5,333,468

[45] Date of Patent: Aug. 2, 1994

[54] APPARATUS FOR PREVENTION OF LOSS OF REFRIGERANT

[76] Inventor: Harold D. Rice, 3762 Old Washington Rd., Waldorf, Md. 20602

[21] Appl. No.: 144,526

[22] Filed: Nov. 2, 1993

[51] Int. Cl.[5] ..... F25B 41/00

[52] U.S. Cl. ..... 62/174; 62/228.3

[58] Field of Search ..... 62/77, 149, 174, 292, 62/193, 228.1, 228.3

[56] References Cited

U.S. PATENT DOCUMENTS 3,353,367 11/1967 Garland et al. .
3,487,656 1/1970 Grant .
4,841,739 6/1989 Wallner .
4,912,933 4/1990 Renken .
5,050,393 9/1991 Bryant .
5,140,827 8/1992 Reedy ..... 62/174
5,259,204 11/1993 McKeown ..... 62/174

*Primary Examiner*—John M. Sollecito
*Attorney, Agent, or Firm*—John K. Donaghy

[57] ABSTRACT

A refrigerant recovering apparatus for cooling equipment having a compressor, an evaporator, and a condenser having a relief valve thereon, the apparatus comprising a chamber having connecting means to the relief valve at one end and connecting means to the compressor at the other end; means on the chamber for conveying the collected refrigerant therein to the compressor; and means for deactivating the compressor upon a predetermined refrigerant pressure in the chamber.

12 Claims, 2 Drawing Sheets

APPARATUS FOR PREVENTION OF LOSS OF REFRIGERANT

BACKGROUND OF THE INVENTION

1. Field of the Invention

This invention pertains to air conditioning equipment, refrigerators and freezers equipped with a liquid cooled condenser having a relief valve for the discharge of refrigerant in the event of over pressurization or failure of the relief valve. Industrial air conditioning equipment of the type used in computer rooms may contain as much as 28 lbs. by weight of refrigerant. If the relief valve should fail, the entire 28 lbs. of refrigerant could be discharged into the computer room and then into the atmosphere.

This discharge is dangerous to the health of workers in the computer room and to the general health of the population through depletion of the ozone layer. The discharge of refrigerant into computer rooms may result in destruction of computer equipment and tapes as well as premature activation of smoke detectors and fire warning systems.

These types of equipment typically have high and low pressure safety switches rated at 250 to 400 PSIG and 0 to 20 PSIG respectively which open and close depending upon the pressures in the system.

The environmental impact of such discharge is obvious and therefore there is a serious need to prevent such discharge into the atmosphere.

2. Background of the Prior Art

U.S. Pat. No. 5,140,827 shows in FIG. 1 a heat pump system 10 having a compressor C with a discharge port P and a suction port S. The discharge port P is connected to a four way valve 18.

This system contemplates automatically adding refrigerant or removing refrigerant from the heat pump depending on the temperature of the compressed refrigerant leaving the discharge port of the compressor 12.

U.S. Pat. No. 5,050,393 shows a refrigeration system FIG. 1 which induces a control device 50 including a reservoir 57 which receives liquid refrigerant from evaporator 12 through line 54.

U.S. Pat. No. 4,912,933 is directed to a transport vehicle refrigeration system, FIG. 1, which includes a reservoir 26 connected to the output of condenser 24. Further, an accumulated tank 44 is shown associated with evaporator 42.

U.S. Pat. No. 4,841,739 is directed toward an automotive air conditioning system which shows an air conditioner system having a compressor 1, a condenser 8 and an evaporator 5 connected together in the usual fashion.

A relief valve 13 is in the refrigerant deliverance line 12 which blows off high pressure refrigerant into reservoir 11. The collected refrigerant may be returned to line 12 via valve 14 under specific conditions, or the collected refrigerant may be returned via valve 15 into the suction line 6.

U.S. Pat. No. 3,487,656 describes a refrigeration system in which various magnetically operated solenoid valves, float switches, timers, etc. are employed in the operation of this system.

U.S. Pat. No. 3,353,367 discloses a refrigerant return system in which a unit 43 senses a maximum and minimum amount of refrigerant and via valves and lines returns refrigerant to the system.

SUMMARY OF THE INVENTION

In current commercial air-conditioning equipment, i.e., those used to cool computer room equipment, there is a requirement that a relief valve be provided on the condenser to relieve the condenser of refrigerant in the event of over pressurization or failure of the valve itself.

This over pressurization or failure can result in a discharge of the refrigerant in the system. The amount of refrigerant discharged can amount to 28 lbs. by weight. This can result in a dangerous situation, i.e., hazardous to workers in an equipment room and depletion of the ozone layer and damage to the air conditioning equipment as well as damage to computers and associated peripherals.

Often, such discharge is not detected until considerable damage has occurred.

There is a need in this environment for an apparatus for preventing the escape of refrigerant into equipment housings, computer rooms and the general environment. One such apparatus will recover refrigerant discharged from the relief valve and shut down of the system and alerting technicians of the discharge and failure of the system.

It is one object of this invention to provide a simple and inexpensive apparatus for recovering discharged refrigerant from a relief valve on commercial air conditioners.

It is another object of this invention to provide a means to shut off the system compressor in the event of a discharge through the relief valve.

Yet another object of this invention is to provide means to visually or audibly alert technicians that a discharge has occurred.

And another object of this invention is to provide an apparatus to recover discharged refrigerant and return the same to the system, thus saving considerable expense in recharging the system with new refrigerant.

The apparatus herein described may be installed in existing relief valves quickly and easily without the need for expensive tools or technical know how.

The result of installation of this apparatus will be a saving of refrigerant, avoidance of depletion of the ozone layer and elimination of hazardous chemicals in equipment housings and computer room environments.

These and other objects of the invention will become apparent to those skilled in the art to which the invention pertains from a reading of the following specification when read with the annexed drawings.

DETAILED DESCRIPTION OF THE PREFERRED EMBODIMENT OF THE INVENTION

Figure 1:
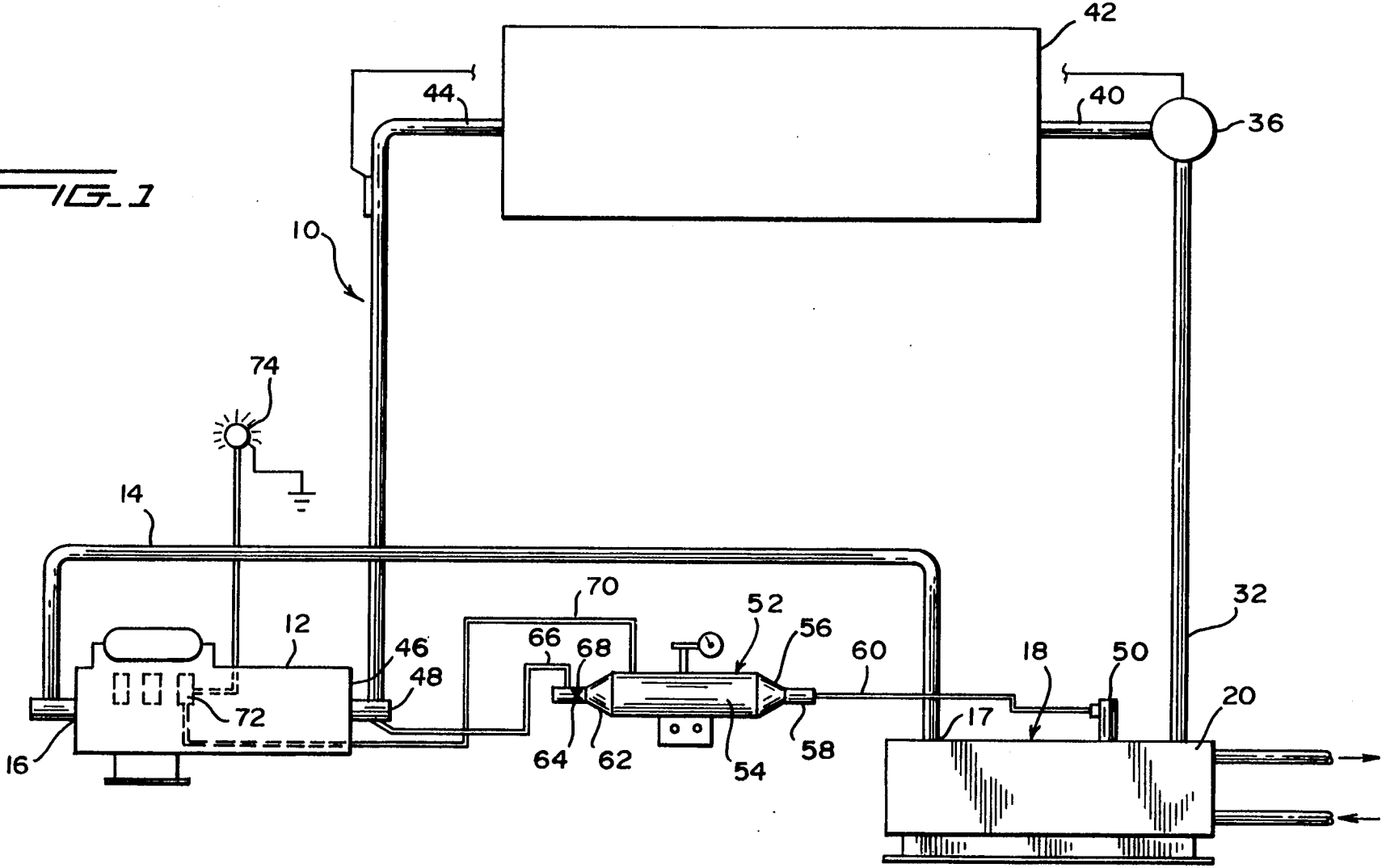
FIG. 1 is a perspective view of an air conditioning system showing the invention placed between the condenser relief valve and the compressor.
Figure 2:
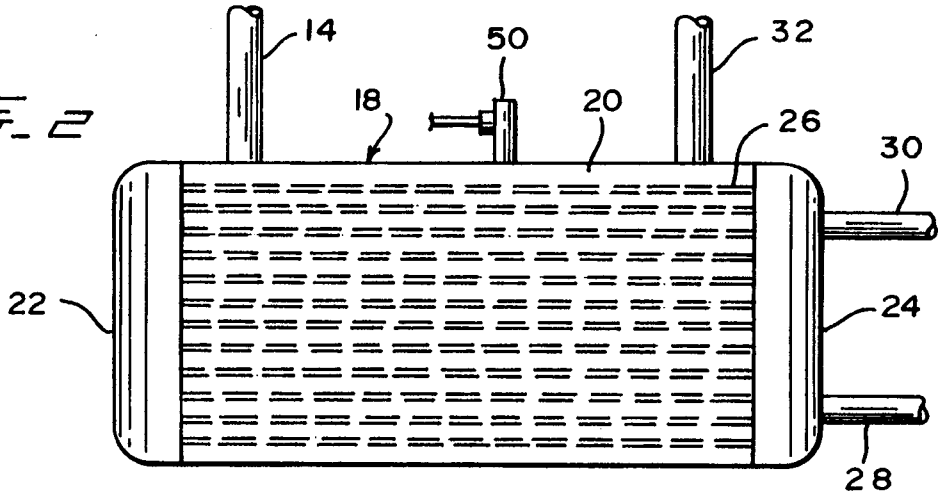
FIG. 2 is a perspective view of the condenser having water conveying coils therethrough and a relief valve thereon.

Referring now in more detail to the drawings, FIGS. 1 and 2 show an air conditioning system 10 having a compressor 12 with a delivery line 14 from the high pressure end 16 to the input 17 of the condenser 18. The condenser 18 is closed hollow housing 20 having sealed ends 22, 24, FIG. 2. The housing 20 contains looped water conveying coils 26 having an inlet pipe 28 and an outlet pipe 30.

The condenser 18 has a refrigerant outlet line 32 which connects to the input of expansion valve 36. Expansion valve 36 has an outlet line 40 connected to evaporator 42 in the usual manner. The low pressure outlet line 44 of the evaporator is returned to the low pressure or suction side 46 of the compressor 12 through an input nipple 48.

The condenser 18 is provided with a safety relief valve 50 which will discharge refrigerant in the event of over pressurization of the condenser housing 20 or of failure of the relief valve. This discharge if not detected is capable of discharging the entire 28 lbs. of refrigerant into the equipment housing or computer room resulting in serious environmental hazard to both equipment and health of workers.

It is therefore desirable to catch or otherwise prevent the loss of refrigerant which may escape from the relief valve 50. To this end, there is provided a chamber 52, FIG. 1, having a generally hollow cylindrical body 54 with a conical end portion 56 and an input nipple 58. A line 60 connects the input nipple 58 to the relief valve 50. The connection of line 60 to nipple 58 may be of any suitable type and is preferably of a screw type by which the line 60 may be disconnected both at the nipple 58 and at the valve 50. In this way, if line 60 is damaged, it is easily replaced. The chamber 52 has an outer conical end portion 62 and a output nipple 64 with relief valve 68 therein. A line 66 connects to relief valve 68 to the suction side input nipple 48 of the compressor 12. The connections are the same releasable type as for line 60.

Thus, there is a continuous path from the relief valve 50 to the input suction side 46 of the compressor 12 through the chamber 52, relief valve 68, and nipple 48. The relief valve 68 in output nipple 64 is activated upon a predetermined pressure in the chamber 54, approximately 400 PSIG.

In addition, the chamber 54 has a connecting line 70 between line 66, valve 68 and a pressure switch 72 on the compressor. The connection 75 to the switch 72 is a T-section one branch of which connects the line 70 to the switch 72. The other branch of the T-section has a valve 77 which permits connection of line 70 to an evacuator to evacuate the refrigerant in the chamber 54. The pressure switch 72 operates at a predetermined low pressure in chamber 54 to turn off the compressor 12, say 20 PSIG. Upon activation of the pressure switch 72, an indicator device 74 turns on to give an indication that the compressor is shut off and that the relief valve has discharged refrigerant. The connections of line 70 to the chamber 52 and switch 72 are screw type or the like to allow removal of the line 70 in the event of damage or rupture.

In operation, upon a discharge of refrigerant from safety relief valve 50, refrigerant under pressure enters chamber 52 through input nipple 58 and conical end 56. Upon reaching a predetermined low pressure of 20 PSIG, safety switch 72 on the compressor is activated whereby the compressor will turn off so that no refrigerant flows through the system 10. The indicator 74 turns on to alert a technician that the relief valve 50 has malfunctioned. As the pressure in the chamber increases and reaches a predetermined high value of approximately 400 PSIG, the valve 68 opens and refrigerant in chamber 52 flows into the suction side 46 of the compressor 12. As soon as the pressure in chamber 52 reaches a predetermined low value, i.e., below 400 PSIG, relief valve 68 shuts off.

It will be noted that this system is not self resetting. The chamber 52 must be evacuated to a pressure of from 20 PSIG to 0 PSIG so that only a small amount, if any, of refrigerant remains in the chamber. In this regard, the valve 77 on the T-section 75 is manually tapped so that the refrigerant in chamber 52 flows to an evacuator device carried by the technician. Once chamber 52 is evacuated to below 20 PSIG, the pressure switch 72 reactivates the compressor whereby the system turns on and returns to normal operation.

Figure 3:
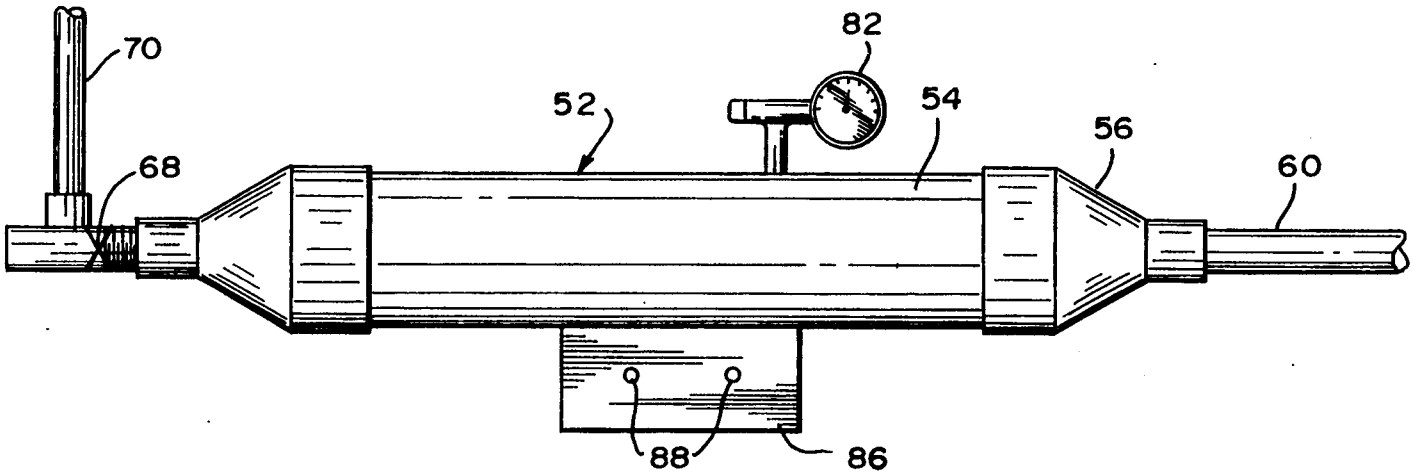
FIG. 3 shows the apparatus of this invention intended to capture refrigerant discharged through the relief valve.

A support plate having apparatus 88 is employed to fastened the chamber 52 to a stable support, FIG. 3.

The use of the refrigerant recovering chamber 52 will reduce substantially the environmental impact which otherwise would occur if refrigerant were to escape into the atmosphere. The environmental hazard is eliminated, workers health is preserved and the cost of replenishing refrigerant is avoided.

The use of the refrigerant receiving chamber 52 and the indicator 74 will enable technicians to detect a malfunction of the relief valve 50 and then prevent the system from being left unactivated thus avoiding dangerous conditions for workers and eliminating environmental hazards.

While the invention has been described with regard to a preferred embodiment thereof, it will be appreciated by those skilled in the art to which the invention pertains that numerous changes may be made to the invention to enhance its operability without departing from the spirit and scope thereof.

What I claim is:

1. A refrigerant recovering apparatus for cooling equipment having a compressor, an evaporator, and a condenser having a relief valve thereon, the apparatus comprising:

a chamber having connecting means to the relief valve at one end and connecting means to the compressor at the other end;

means on the chamber for conveying refrigerant therein to the compressor; and means for deactivating the compressor upon a predetermined refrigerant pressure in the chamber.

2. A refrigerant recovering apparatus for cooling equipment having a compressor, an evaporator, and a condenser having a relief valve thereon according to claim 1, wherein:

said chamber has conical input and output ends and means on the conical output end to permit passage of refrigerant in the chamber to the compressor.

3. A refrigerant recovering apparatus for cooling equipment having a compressor, an evaporator, and a condenser having a relief valve thereon according to claim 1, and said connecting means comprises disconnectable conveying lines connected to said input end and output end and said output end connected through said valve means on the output end to the compressor.

4. A refrigerant recovering apparatus for cooling equipment having a compressor, an evaporator, and a condenser having a relief valve thereon according to claim 1, and indicator means to indicate discharge of the relief valve.

5. A refrigerant recovering apparatus for cooling equipment having a compressor, an evaporator, and a condenser having a relief valve thereon according to claim 1, wherein:

said connecting means on the chamber being at least one conveying line to convey refrigerant in the chamber to the compressor upon a predetermined low pressure or high pressure in the chamber.

6. A refrigerant recovering apparatus for cooling equipment having a compressor, an evaporator, and a condenser having a relief valve thereon according to claim 1, wherein:

means for indicating pressure in the chamber.

7. A refrigerant recovering apparatus for cooling equipment having a compressor, an evaporator, and a condenser having a relief valve thereon according to claim 1, and means on the chamber for supporting the chamber on a stable support.

8. A refrigerant recovering apparatus for cooling equipment having a compressor, an evaporator, and a condenser having a relief valve thereon according to claim 5, wherein:

said connecting means is a conveying line to convey low pressure in the chamber to said switch whereby said low pressure activates a pressure switch on the compressor to shut off the compressor.

9. A refrigerant recovering apparatus for cooling equipment having a compressor, an evaporator, and a condenser having a relief valve thereon according to claim 5, and said connecting means on the chamber is a conveying line through a valve to discharge refrigerant in the chamber to the compressor upon reaching a predetermined high pressure.

10. A refrigerant recovering apparatus for cooling equipment having a compressor, an evaporator, and a condenser having a relief valve thereon according to claim 5, wherein:

said low pressure is 20 PSIG.

11. A refrigerant recovering apparatus for cooling equipment having a compressor, an evaporator, and a condenser having a relief valve thereon according to claim 5, wherein:

said high pressure is 400 PSIG.

12. A refrigerant recovering apparatus for cooling equipment having a compressor, an evaporator, and a condenser having a relief valve thereon according to claim 9, and said valve is in said output end and is responsive to said high pressure.

* * * * *